US005335975A

United States Patent [19]

Krouskop et al.

[11] Patent Number: 5,335,975

[45] Date of Patent: Aug. 9, 1994

[54] BODY SUPPORT SYSTEM

[75] Inventors: Thomas A. Krouskop, Stafford, Tex.; Ruth H. Lusher, Vienna, Va.

[73] Assignee: The Institute For Rehabilitation And Research, Houston, Tex.

[21] Appl. No.: 90,358

[22] Filed: Jul. 12, 1993

Related U.S. Application Data

[63] Continuation-in-part of Ser. No. 818,958, Jan. 10, 1992, abandoned.

[51] Int. Cl.[5] ..... A47C 7/02

[52] U.S. Cl. ..... 297/452.63; 297/452.1

[58] Field of Search ..... 297/452.1, 452.11, 452.19, 297/452.27, 452.63

[56] References Cited

U.S. PATENT DOCUMENTS

| | | | |
|---|---|---|---|
| 242,633 | 6/1881 | Guerrant | 297/452.63 |
| 2,798,537 | 7/1957 | Bird | 297/452.63 |
| 4,192,547 | 3/1980 | Geier | 297/452.63 |

FOREIGN PATENT DOCUMENTS

| | | | |
|---|---|---|---|
| 0323185 | 12/1929 | United Kingdom | 297/452.63 |

*Primary Examiner*—Kenneth J. Dorner
*Assistant Examiner*—Milton Nelson, Jr.
*Attorney, Agent, or Firm*—Fulbright & Jaworski

[57] ABSTRACT

A body support system, such as a chair or bed, having a pair of support rails and a plurality of rows of flexible cords. The cords are generally perpendicular to the rails and parallel to each other. A plurality of elongate rigid support links are rigid supported from adjacent rows of cords. Alternate links along each row extend in opposite directions for providing a continuous, conformable low interface pressure, body support surface.

7 Claims, 2 Drawing Sheets

BODY SUPPORT SYSTEM

CROSS REFERENCE TO RELATED APPLICATIONS

This application is a continuation-in-part of copending application Ser. No. 07/818,958 filed Jan. 10, 1992 entitled "Chair Seating System", now abandoned.

BACKGROUND OF THE INVENTION

The present invention relates to a body support system such as a chair or bed and particularly one that includes rigid links that are interconnected on rows of parallel cord supports that can conform to the contour of the body, provide lower interface pressure, and can accommodate to the occupant's position.

Traditional chair seats, particularly wheel chair seats are composed of a stiff plate with a soft cushion or a piece of upholstery material that forms a hammock and is then covered with a compliant cushion. In addition there are specialized wheel chair seats that are made of formable matrixes, contoured foam, or cast materials that form fit the body.

The present body support system is composed of rigid links that are interconnected on flexible cords so that they form a support surface that can conform to the contours of the body. Moreover, the conformation can accommodate as the position of the occupant changes. When changing, the interface pressures will remain low and the stability of the user is maximized. The provision of lower interface pressures is particularly useful in wheelchair seats and in other seats and beds used by invalids for extended periods of time. Lower interface pressure is important in preventing the development of body sores.

SUMMARY

The present invention is directed to a body support system which includes a pair of support rails spaced from each other and being parallel to each other. A plurality of equally spaced rows of flexible cords are positioned between and supported from the rails. The cords are generally perpendicular to the rails and parallel to each other. Said rows of flexible cord are formed from a continuous cord connected through the support rails. A plurality of elongate, rigid support links each having first and second ends and each of the links include first and second cords receiving holes adjacent the first and second ends, respectively. One of the holes of each link receives one row of cords and the other of said holes of the same link receives an adjacent cord row thereby supporting the links, each forming a plurality of columns of links transverse to the rows of cords in which adjacent columns have contacting sides. Alternate columns of links are offset from adjacent columns of links for providing a continuous conformable, low pressure interface, body support surface. The first and second ends of the links are rounded to reduce the possibility of pinching the user. The first and second holes in each link are spaced apart a distance approximately one-half of the length of a link whereby the first ends of the links are positioned closely adjacent the second ends of the longitudinally aligned links in each column for maximizing the link support area for supporting a body but still freely rotate to produce a deformable support surface. The links have a width and a height and the width of the link is substantially less than the height for allowing the links to better accommodate to the body shape and provide lower interface pressure.

Another object is the provision of links limited to certain widths and lengths for optimizing the load distribution characteristics of the links.

Still another object is the provision of end links which will not roll.

Still a further object of the present invention is wherein the elongate links have a longitudinal axis and the holes are positioned above the longitudinal axis for allowing the links to readily return to a neutral position from a used position.

Still a further object of the present invention is wherein the links have sides which are flat and entirely mate with the flat sides of adjacent columns of links for maximizing the support area of the seat thereby lowering contact pressure with a body.

Other and further objects, features and advantages will be apparent from the following description of a presently preferred embodiment of the invention, given for the purpose of disclosure and taken in conjunction with the accompanying drawings.

BRIEF DESCRIPTION OF THE PREFERRED EMBODIMENT

Figure 1:
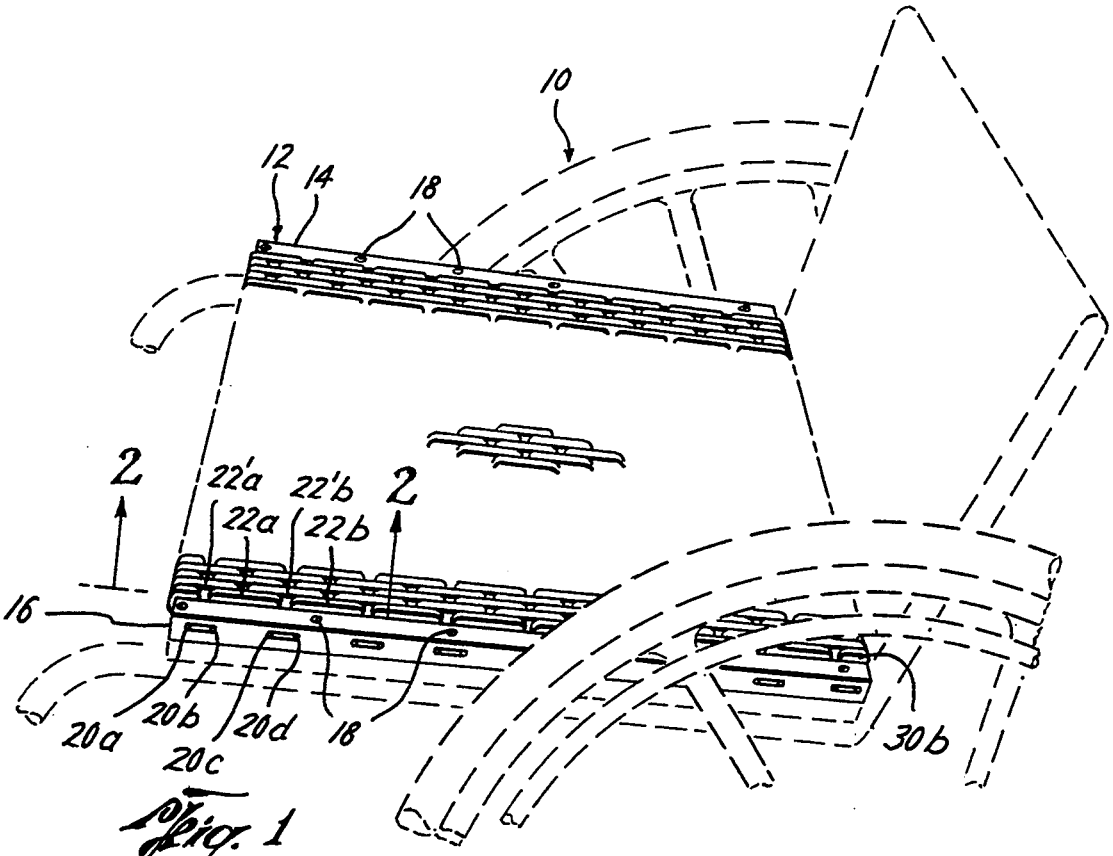
FIG. 1 is a fragmentary elevational view, in perspective, illustrating the seat system of the present invention in use in a wheelchair, shown in dotted outline.

While the chair seat system of the present invention is particularly useful in connection with various body supports such as beds, chair backs and chair seats, it will be so described for purposes of illustration only, as used in a wheelchair seat.

Referring now to the drawings, the reference 10 generally indicates a chair, such as wheelchair containing the seat system 12 of the present invention.

The seat system includes a pair of support rails 14 and 16 spaced from each other and being generally parallel to each other and secured to the chair 10 by fasteners 18 such as bolts or screws.

Figure 2:
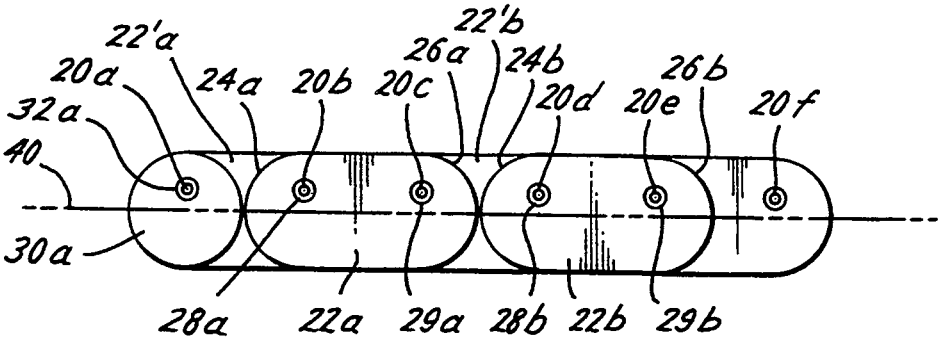
FIG. 2 is an enlarged cross-sectional view taken along the line 2—2 of FIG. 1.

A plurality of equally spaced rows of flexible cords 20*a*, 20*b*, 20*c*, 20*d*, 20*e*, 20*f* . . . 20*n*, as best seen in FIG. 2 are provided positioned between and supported from the rails 14 and 16. The cords are generally perpendicular to the rails 14 and 16 and parallel to each other. Preferably, the cords are formed from one continuous cord and may be of a material which is attached to and supported to the rails 14 and 16 in a manner similar to a tennis racket. Preferably, multiple strands of flexible cord are used to produce a varied stiffness in the seat as the seat is loaded with increasing weight.

A plurality of elongate rigid support links 22*a*, 22*b*, . . . 22*n*, are provided. The links have first and second ends and the links include first and second cord receiving holes adjacent said first and second ends, respectively. Thus, link 22a includes a first end 24a and second end 26a with a first cord receiving hole 28a adjacent the first end 24a and a second cord receiving hole 29a adjacent the second end 26a. One of the holes of each link receives one row of the cords and the other said hole of the same link receives an adjacent cord row thereby supporting the links. Thus, flexible cord row 20b passes through the hole 28a and a second adjacent cord row 20c passes through the hole 29a. Thus, the cords 20b and 20c support the link 22a. Similarly, cords 20d and 20e support the link 22b. Preferably the holes are larger than the outside of the cords thereby allowing the links to rotate on the cords. That is, the holes 28a and 29a are larger than the diameter of the cords 20b and 20c thereby allowing the links 22a to rotate relative to the cords 20b and 20c as an occupant sets upon the top of the seat 12 and thus on the top of the link 22a.

In addition, it is noted that the ends of the links are rounded. Thus the ends 24a and 26a of the link 22a are rounded so that as the link 22a rotates from the normal neutral position shown in FIG. 2 the interface pressure between an occupant of the chair and the link 22a will remain low. Also, by being rounded, the ends can be positioned closely spaced to adjacent links and provide support while rotating. Furthermore, the rounded ends reduce the possibility of punching the user.

Furthermore, the first and second holes in each link, for example, holes 20b and 20c in link 22a are spaced apart a distance of approximately one-half of the length of a link whereby the first ends of the links are positioned closely adjacent the second ends of longitudinally aligned links in each column for maximizing the link support area for supporting a body. For example, end 26a of link 22a is positioned closely adjacent the end 24b of link 22b because of the spacing of the holes 28a, 29a, 28b, and 29b. This minimizes the space between the ends of adjacent links for providing lower interface pressure. The spacing of the holes in the links allows the rounded ends of the links to be brought into close proximity, providing maximum support, but still freely rotate to produce a deformable surface.

As shown in FIG. 2, each of the links 22a and 22b are supported from adjacent rows of cords. However, alternate links along each row are offset or extend in opposite directions for providing a closed body conformable low pressure interface support surface. That is, the next adjacent row of links along each row of cords are offset. This feature spreads out the load again providing lower interface pressure. Thus, 22'a, while identical to link 22a, is in the next adjacent row along the cords and is connected to and supported from cords 20a and 20b. And link 22'b, while identical to the other links, is connected to and supported from cords 20c and 20d. This insures that all of the links are intermeshed, overlapping, although offset, to provide a fully supported seat surface. Preferably, the sides of the links are flat and substantially entirely mate with the flat sides of adjacent columns of links for again maximizing the support area of the seat thereby lowering contact pressure with a body.

Figure 7:
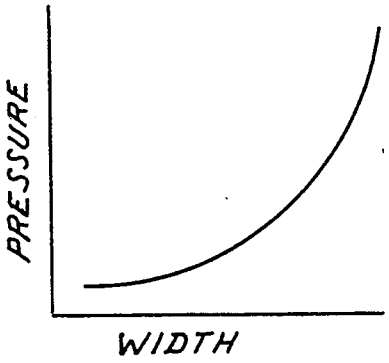
FIG. 7 is a graph of pressure versus width of a link.
Figure 8:
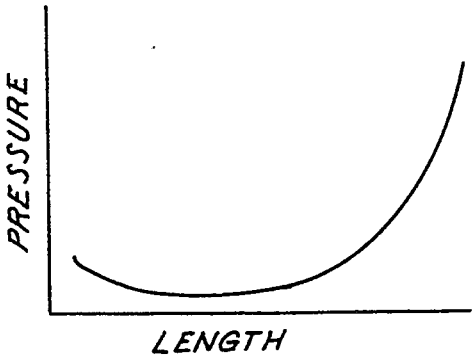
FIG. 8 is a graph of pressure versus length of a link.

Preferably, the links 22a . . . 22n may be of any suitable rigid material. One suitable material is wood and, by way of example only, links having a longitudinal dimension of approximately $1\frac{7}{8}$ inches, a height of 1 inch, and a thickness of $\frac{1}{4}$ inch, and the holes in each link are spaced apart approximately 1 inch, have found to be satisfactory. The links 22a . . . 22n are dimensioned to optimize the load redistributing characteristics of the seat. As best seen in the graph in FIG. 7, as the width of the links increase the pressure increases. It has been found that the width of the links 22a . . . 22n are preferably no wider than 0.4 inches for preferable pressure interfaces. And graph 8 shows the relationship between the pressure and the lengths of the links 22a . . . 22n. That is, pressure interfaces increase with both long and short links. Preferably, the length should be between one and two inches long approximately.

In fact, such rigid links provide the mechanical properties that do not change significantly with time, and the rigid links remain rigid compared to the tissue of the occupant. The transverse cords 20a . . . 20n allow the rigid links to rotate about the longitudinal axis of the cord and fit the contours of the occupant's body. Furthermore, the seat 14 accommodates changing in the seating posture of the occupant with no significant change in postural support or interface pressure. In addition, a seat 14 can be used in wet environments like a shower without causing changes in the support characteristics. And the support rails 14 and 16 can be fitted almost any type seat and particularly on wheelchair frames or shower chair frames. The tension built into the rows of cords can be adjusted to control the degree to which the links conform and the tension can be used to control posture as well as interface pressures.

Because alternate rows of links are offset, it is desirable to provide a front link 30a and a back link 30b in alternate rows which contain a single hole 32a merely as spacer elements. The spacer element 30a is supported solely on cord row 20a in alternate link rows.

As best seen in FIG. 2 it is preferable that the holes 32a, 28a . . . 28n and 29a . . . 29n are positioned above the longitudinal axis 40 of the links, for example a quarter of an inch. This offset in the position of the holes from the longitudinal axis of the links allows the links to readily return to a level or neutral position when a occupant gets up from the seat.

Figure 3:
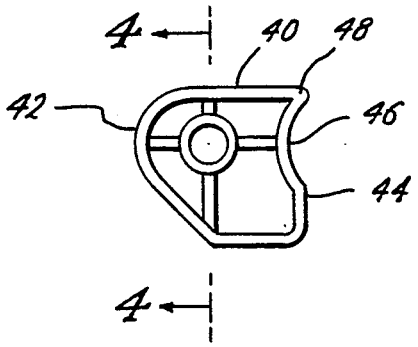
FIG. 3 is an enlarged elevational view of a preferred front and back link.
Figure 4:
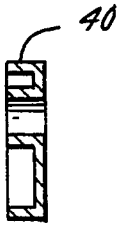
FIG. 4 is a cross-sectional view taken along line 4—4 of FIG. 3.
Figure 5:
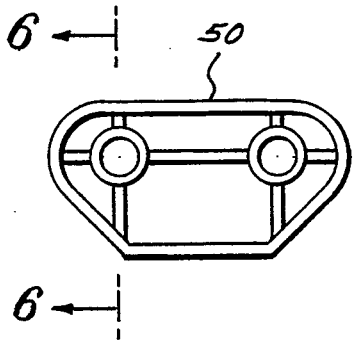
FIG. 5 is an enlarged elevational view of a preferred embodiment of a link.
Figure 6:
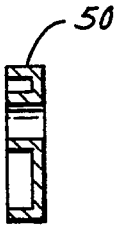
FIG. 6 is a cross-sectional view taken along line 6—6 of FIG. 5.

Referring now to FIGS. 3 and 4, the preferred embodiment of the end link is shown, and referring to FIGS. 5 and 6, the preferred embodiment of the other links are shown. The end link 40, preferably molded plastic, includes a first end 42 and a second end 44. The first end 42 includes a curved convex portion engaging a user. The second end 44 includes a curved convex portion 46 for coacting with the rounded end of link 50 (FIGS. 5 and 6). In addition, the second end 44 includes a stop shoulder 48 to engage the surface of a link 50 to prevent the link 40 from rolling over and causing an uneven surface. Link 50 can be used in place of links 22a . . . 22n and is dimensioned similarly thereto.

The present invention, therefore, is well adapted to carry out the objects and attain the ends and advantages mentioned as well as others inherent therein. While a presently preferred embodiment of the invention has been given for the purpose of disclosure, numerous changes in the details of construction and arrangement of parts will be readily apparent to those skilled in the art and which are encompassed within the spirit of the invention and the scope of the appended claims.

What is claimed is:

1. A body support system comprising, a pair of support rails spaced from each other and being parallel to each other, a plurality of equally spaced rows of flexible cords positioned between and supported from the rails, said cords being generally perpendicular to the rails and parallel to each other, said rows of flexible cords are formed from a continuous cord connected through the support rails, a plurality of elongate rigid support links each having first and second ends, each of said links including first and second cord receiving holes adjacent said first and second ends, respectively, one of said holes of each link receives one row of the cords and the other of said holes of the same link receives an adjacent cord row thereby supporting the links, and forming a plurality of columns of links transverse to the rows of cords in which adjacent columns have contacting sides, alternate columns of links are offset from adjacent columns of links for providing a continuous conformable, low pressure interface, body support surface, the first and second ends of the links are rounded and the first and second holes in each link are spaced apart a distance of approximately one half of the length of a link whereby the first ends of the links are positioned closely adjacent the second ends of longitudinally aligned links in each column for maximizing the link support area for supporting a body, and said links have a width and a height and the width of the links is substantially less than the height for allowing the links to better accommodate to the body shape and provide lower interface pressure, wherein the maximum length of the links is 2 inches.

2. The body support system of claim 1 wherein the maximum width of the links is 0.4 inch.

3. The body support system of claim 1 wherein the minimum length of the links is 1 inch.

4. The body support system of claim 1 including front and rear links having first and second ends, the first end of the front and rear links being concave and the second end of the front and rear links having a convex portion for receiving another link.

5. The body support of claim 4 including a stop shoulder at the top of the convex portion for engaging an adjacent link and preventing rolling of the adjacent link.

6. A body support system comprising, a pair of support rails spaced from each other and being parallel to each other, a plurality of equally spaced rows of flexible cords positioned between and supported from the rails, said cords being generally perpendicular to the rails and parallel to each other, said rows of flexible cord are formed from a continuous cord connected through the support rails, a plurality of elongate rigid support links each having first and second ends, each of said links including first and second cord receiving holes adjacent said first and second ends, respectively, one of said holes of each link receives one row of the cords and the other of said holes of the same link receives an adjacent cord row thereby supporting the links, and forming a plurality of columns of links transverse to the rows of cords in which adjacent columns have contacting sides, alternate columns of links are offset from adjacent columns of links for providing a continuous conformable, low pressure interface, body support surface, the first and second ends of the links are rounded and the first ends of the links are positioned closely adjacent the second ends of longitudinally aligned links in each column for maximizing the link support area for supporting a body, said links have a width and a height and the width of the links is substantially less than the height for allowing the links to better accommodate to the body shape and provide lower interface pressure, and wherein the elongate links have a longitudinal axis and the holes are positioned above the longitudinal axis for allowing the links to readily return to a neutral position from a used position.

7. A body support system comprising, a pair of support rails spaced from each other and being parallel to each other, a plurality of equally spaced rows of flexible cords positioned between and supported from the rails, said cords being generally perpendicular to the rails and parallel to each other, said rows of flexible cord are formed from a continuous cord connected through the support rails, a plurality of elongate rigid support links each having first and second ends, each of said links including first and second cord receiving holes adjacent said first and second ends, respectively, one of said holes of each link receives one row of the cords and the other of said holes of the same link receives an adjacent cord row thereby supporting the links, and forming a plurality of columns of links transverse to the rows of cords in which adjacent columns have contacting sides, alternate columns of links are offset from adjacent columns of links for providing a continuous conformable, low pressure interface, body support surface, the first and second ends of the links are rounded and the first ends of the links are positioned closely adjacent the second ends of longitudinally aligned links in each column for maximizing the link support area for supporting a body, said links have a width and a height and the width of the links is substantially less than the height for allowing the links to better accommodate to the body shape and provide lower interface pressure, and wherein the links have sides which are flat and substantially entirely mate with the flat sides of adjacent columns of links for maximizing the support area of the seat thereby lowering contact pressure with a body.

* * * * *